US007958884B2

(12) United States Patent
Pieti

(10) Patent No.: US 7,958,884 B2
(45) Date of Patent: Jun. 14, 2011

(54) BURNER FOR SOLID FUEL

(76) Inventor: Paulu Pieti, Terälahti (FI)

( * ) Notice: Subject to any disclaimer, the term of this patent is extended or adjusted under 35 U.S.C. 154(b) by 0 days.

(21) Appl. No.: 10/478,059

(22) PCT Filed: May 14, 2002

(86) PCT No.: PCT/FI02/00407

§ 371 (c)(1),
(2), (4) Date: Nov. 18, 2003

(87) PCT Pub. No.: WO02/095296

PCT Pub. Date: Nov. 28, 2002

(65) Prior Publication Data

US 2004/0129262 A1 Jul. 8, 2004

(30) Foreign Application Priority Data

May 18, 2001 (FI) ..... 20011053
Jan. 28, 2002 (FI) ..... 20020152

(51) Int. Cl.
*F24C 1/14* (2006.01)

(52) U.S. Cl. ..... 126/146; 126/77; 126/163 R

(58) Field of Classification Search ..... 126/77, 126/146, 151, 152 R, 163 A, 163 R, 225; 110/251, 252, 298
See application file for complete search history.

(56) References Cited

U.S. PATENT DOCUMENTS

| | | | | | |
|---|---|---|---|---|---|
| 21,046 | A | * | 7/1858 | Dorsch | 126/152 R |
| 1,246,416 | A | | 11/1917 | Gibbs | |
| 1,305,710 | A | * | 6/1919 | Gibbs | 110/251 |
| 1,561,543 | A | * | 11/1925 | Hoult | 126/153 |
| 1,586,548 | A | * | 6/1926 | Foltyn | 126/225 |
| 1,596,204 | A | * | 8/1926 | Martin | 126/225 |
| 1,607,312 | A | * | 11/1926 | Schierenbeck | 126/163 R |
| 1,609,561 | A | * | 12/1926 | Listerman | 126/99 R |
| 2,949,209 | A | | 8/1960 | Schott | |
| 3,213,947 | A | | 10/1965 | Rogers, Jr. et al. | |
| 3,683,650 | A | | 8/1972 | Hirschburger | |
| 4,338,915 | A | | 7/1982 | Martonfi, Sr. | |
| 4,502,464 | A | | 3/1985 | Figueroa | |
| 4,719,899 | A | | 1/1988 | Burkhart | |
| 5,941,234 | A | | 8/1999 | Norburn et al. | |
| 5,983,885 | A | | 11/1999 | Jarvi | |

FOREIGN PATENT DOCUMENTS

| | | |
|---|---|---|
| CH | 137411 | 3/1930 |
| DE | 195379 | 8/1906 |
| DE | 542370 | 12/1931 |
| DE | 3601807 | 7/1987 |
| FI | 11234 | 3/1925 |
| FR | 1208802 | 2/1960 |
| GB | 2101737 | 1/1983 |
| WO | 98/29686 | 7/1998 |

* cited by examiner

*Primary Examiner* — Jiping Lu
(74) *Attorney, Agent, or Firm* — Venable LLP; Eric J. Franklin

(57) ABSTRACT

The invention relates to a burner for solid fuel containing a space for a solid fuel to be burned, in which solid fuel space the flow of gas is arranged to be possible. The burner comprises at least one fire pipe (3,13) inside the solid fuel space, through the wall of which a possibility for gas flow is arranged.

8 Claims, 2 Drawing Sheets

BURNER FOR SOLID FUEL

FIELD OF THE INVENTION

The present invention relates to a burner for solid fuel containing a space for solid fuel to be burned, in which solid fuel space flow of gas is arranged to be possible.

BACKGROUND OF THE INVENTION

Solid fuel burners are disclosed in the following publications:

Publication GB 2101737 discloses a grate to be placed in a furnace, said grate comprising low side walls. The grate can be moved in the furnace in such a manner that for example the cleaning of the furnace is facilitated.

Publication U.S. Pat. No. 2,949,209 discloses a waste burner whose walls contain holes for air intake.

Publication U.S. Pat. No. 3,213,846 discloses a furnace that can be used both for heating and cooking.

Publication U.S. Pat. No. 4,719,899 discloses an arrangement for efficient burning of granular fuel.

Publications U.S. Pat. No. 5,941,234 and WO 98/29686 disclose a burner equipped with holes for air intake, the bottom of which burner is advantageously in an oblique position. The burner can be used in furnaces, such as ovens and fireplaces.

Publication U.S. Pat. No. 5,983,885 discloses a furnace in which pellets can be constantly supplied.

Solid fuel burners can be separate burners placed inside a furnace, burners used without a surrounding furnace, or the burner can be furnace with a mantle that stores thermal energy. Known furnaces comprising a heat storing mantle are typically fireplaces or ovens or combinations of these. The mantle can be for example made of tiles or steatite.

In known burners of solid fuel the fuel charge is usually lit from outside and the combustion is directed from outside the fuel charge to the inside. The fire propagates towards the centre of the fuel charge from all sides, wherein combustion takes place slowly and in an uncontrolled and imperfect manner. The combustion causes a great deal of smoke and the burning temperature is low, wherein large amounts of unburned gases are produced. Substantial production of smoke causes stains the air conduits and the efficiency of the combustion is poor.

SUMMARY OF THE INVENTION

By means of the burner according to the invention it is possible to avoid the above-mentioned problems. The solid fuel burner according to the invention is characterized in that it comprises at least one fire pipe inside the space for solid fuel, a possibility for gas flow being arranged through the wall of said fire pipe.

In the burner according to the invention, solid fuel such as wood chips, pellets, sawdust, peat or chopped wood burns in a controlled manner almost completely and the combustion gases produced during the combustion are so pure that they do not stain the air conduits. The combustion takes place substantially at constant efficiency. Pellets that contain a great deal of energy in relation to their volume constitute especially advantageous solid fuel.

In order to be able to safely use the burner with a good efficiency and in such a manner that the burner is durable in use, the fire pipe must extend above the level determining the upper level of the solid fuel space. In other cases the efficiency of the burner must be restricted unnecessarily, because there is a risk that the burner is damaged as a result of excessive heat. In addition to the above-mentioned advantages it is also possible to attain a simple structure by means of such an arrangement, because additional parts for directing the fire are not necessary. In practice, the level determining the upper surface of the solid fuel space is often the point where the cover closing the solid fuel space is placed.

According to an embodiment of the invention, the solid fuel burner according to the invention can be placed in an existing furnace, such as an oven, a fireplace or a stove. One preferred target of use is a heat storing fireplace equipped with doors. According to a second embodiment of the invention the burner can be without the surrounding furnace as such. According to a third embodiment of the invention the burner is a furnace comprising a heat storing mantle, a discharge opening for combustion gases and a combustion space. During the combustion heat energy binds itself to the heat storing mantle of the furnace, which can be made of for example tiles or steatite.

The size of the burner varies according to the use. Solid fuel can be supplied in the burner in one fuel charge or the burner can be filled up constantly as the combustion continues. Typically, however, the burner is filled before fire is set therein, and thereafter the fuel located in the burner is burned without adding new fuel. The burner can be used for example for heating of one-family houses or water. In the burner according to the invention the burning takes place in such a manner that the solid fuel is gasified and the gasified fuel burns in the middle of the burner.

The burner according to the first and second embodiment of the invention comprises at least a container and a fire pipe. Furthermore, it can also contain a cover, an air intake pipe and a grate. The container comprises at least one side wall and a base. The number of the side walls depends on the shape of the container. Advantageously, the container has a cylindrical shape, wherein there is only one side wall. The container can be placed vertically or horizontally. The container has a space for solid fuel a possibility for gas flow is arranged within this space. The side walls of the container can have air intake openings spread evenly over the entire surface area of the side walls. The shape of the air intake openings can be selected freely according to the desired outer appearance. However, the location of the air intake openings is significant for guiding radiating heat to a desired target. The solid fuel space can also be another container to be placed inside the container, the wall of which is for example net-like, wherein the flow of gas is possible via the space remaining between the walls of the containers.

In the container, advantageously in its side wall, there is a lead-through advantageously for a cylindrical air intake pipe. The air intake pipe is installed to a substantially horizontal position via the lead-through. The diameter of the air intake pipe is selected according to the use. The air intake pipe is connected to a fire pipe installed in a substantially vertical position inside the container.

The fire pipe has advantageously a cylindrical shape and a possibility for gas flow is arranged through the wall of the same. The possibility for gas flow can be arranged in such a manner that the wall of the fire pipe contains openings in such a manner that at least 30% of the surface area that is located inside the container consists of the openings. The fire pipe can be supported from its upper part with a cover that is placed on top of the container and contains a lead-through for the fire pipe. The cover is not, however, necessary in the burner, but the burner can also be used without the cover. The fire pipe is advantageously located in the container in such a manner that it is positioned vertically in the middle of the container. When the container has a large volume and the amount of solid fuel is large, it is possible to use several fire pipes at fixed intervals.

In the lower part of the fire pipe, above the air intake pipe there is a grate containing a lead-through for the fire pipe. The grate is advantageously a perforated plate extending to the walls of the container, or a suitably rigid net that is similar in shape with the cross-section of the container.

The burner is composed of high temperature and fire resistant materials, advantageously of metal. The raw materials of the burner can vary depending on the number of times of use the burner is desired to be usable, as well as how large container volumes are utilized. The dimensioning of the burner is conducted on the basis of optimal combustion conditions. If the gas remains too poor, combustion does not take place. One important factor is the distance of the fire pipe from the wall of the container, in other words the layer of fuel that remains between the fire pipe and the inner wall of the container.

The burner according to a third embodiment of the invention, which is a furnace, comprises a heat storing mantle, a discharge opening for combustion gases and a combustion space. The combustion space is restricted by the heat storing mantle of the furnace and the mouth of the furnace, which can contain doors that can be closed. The combustion space comprises a fire pipe, through the wall of which a possibility for gas flow is arranged. The fire pipe is a pipe installed inside the furnace in a substantially vertical position, said pipe tapering off towards its upper end. The cylindrical mantle of the pipe contains openings whose total surface area is at least 30%, advantageously at least 40%, of the entire surface area of the mantle wall of the fire pipe. The openings of the fire pipe travel advantageously diagonally on the wall of the mantle of the fire pipe, so that when their travel direction is examined from outside to the inside, the travel direction is upwards from a lower level. It is a purpose of this arrangement to keep the openings of the fire pipe open, in other words ash does not accumulate on the wall of the fire pipe, but it flows out of the openings. It is important that the openings are oblique, because the material of the wall of the fire pipe is relatively thick. The wall of the fire pipe is made of fireproof material, for example of ceramics or iron alloy. The fire pipe is advantageously made by casting.

Between the wall of the furnace and the fire pipe there is a partition wall equipped with air intake openings. It is a purpose of the partition wall to form inside itself but outside the fire pipe a fuel space in which the fuel is located. When seen from outside to the inside, the travel direction of the air intake openings is advantageously upwards from a lower level. The partition wall can be a continuous wall that has a shape of a cut cone or cylinder, or it can be formed of several parts connected to each other.

Outside the mantle of the fire pipe, in the upper part of the fire pipe there is a cover that closes the combustion space and assists in directing the combustion to the fire pipe and for its part promotes the reduction of discharge. The cover is usually located on the same level with the lowest part of the doors of the furnace, and the fire pipe extends at least slightly over the level of the cover.

Below the combustion space of the furnace there is an ash space. The combustion space and the ash space are separated by an adjustable grate that can be formed of two superimposed fire grates. The grate can be adjusted manually or automatically.

Fire can be set into the furnace with an automatic function for example in such a manner that in the vicinity of the fire pipe there is an electric resistance that sets the fuel on fire at a predetermined moment of time.

The act of closing and opening the discharge opening of the combustion gases as well as the adjustment of the holes of the grate can also be arranged by means of an automatic function. The automatic functions are preferably connected to each other to occur in a set order, and measurement functions may be connected thereto to determine the moment of a certain event.

BRIEF DESCRIPTION OF THE DRAWINGS

In the following, the invention will be described with reference to the appended drawings, in which.

DETAILED DESCRIPTION OF THE INVENTION

Figure 1:
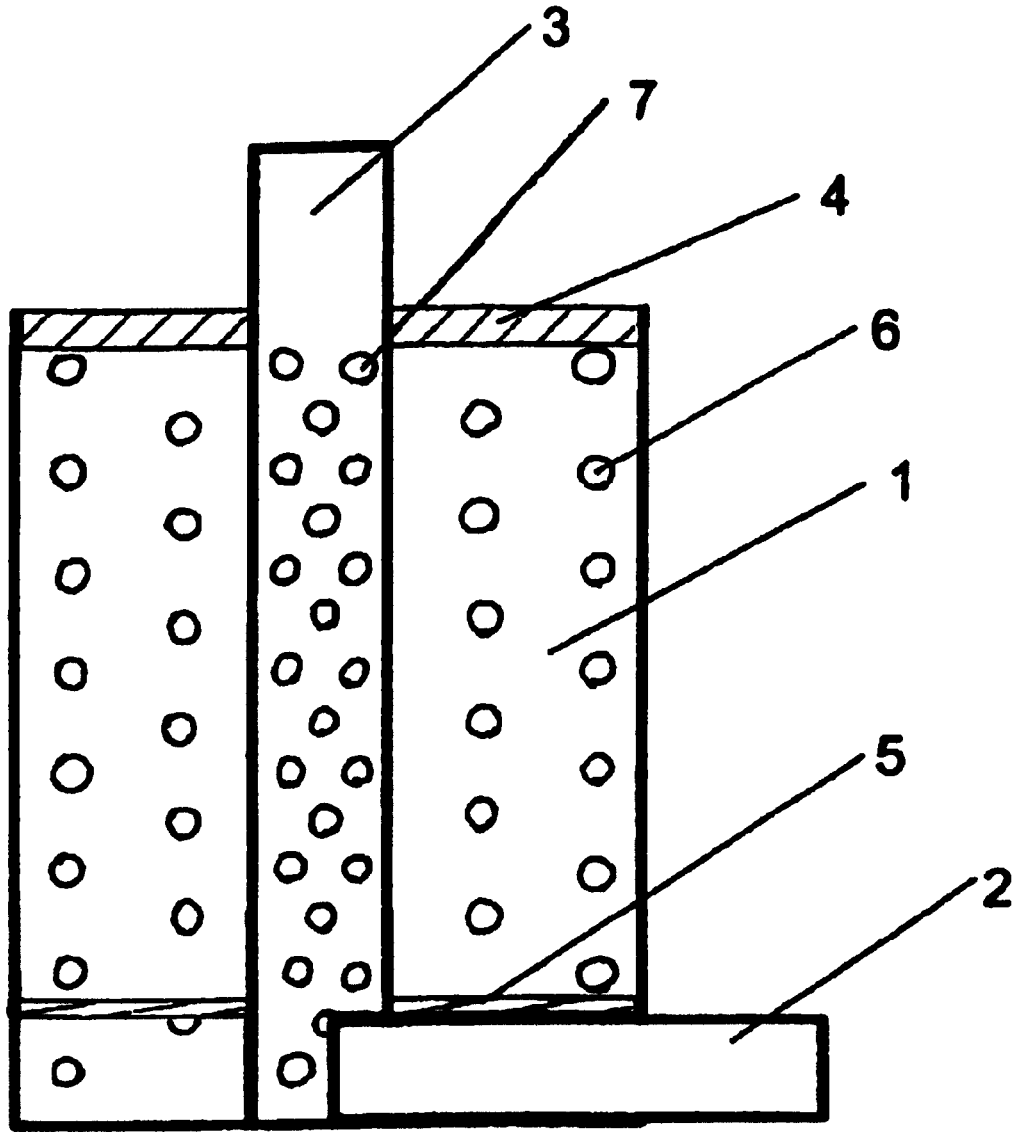
FIG. 1 shows a cross section of the solid fuel burner according to the first and second embodiment of the invention.

The solid fuel burner according to FIG. 1 comprises a container 1 that is composed of a cylindrical wall and a round base element. The cylindrical section is equipped with air intake openings 6 spread at equal intervals on the entire surface area of the cylinder. The container may contain handholds or handles by means of which it is possible to carry the burner. The lower part of the vertical wall of the container 1 contains a lead-through for an air intake pipe 2 to be installed in a substantially horizontal position. The diameter of the air intake pipe is selected according to the use, in a 20-liter container it may be 50 mm. Advantageously, the air intake pipe has a cylindrical shape.

The air intake pipe 2 is connected to a fire pipe 3 placed in a substantially vertical position, said fire pipe containing a lead-through for the air intake pipe 2. The lead-through can be for example an area removed from the lower part of the fire pipe 3, in which it is possible to fit the end of the air intake pipe 2. Advantageously, the fire pipe 3 has a cylindrical shape and it is perforated in such a manner that it contains openings 7 with a diameter of approximately 5 mm, the total surface are of which is over 30% of the entire surface area of the fire pipe. The openings are spread evenly at least over the entire surface area of the wall of the fire pipe that remains inside the container 1. In a 20-liter container the diameter of the fire pipe can be 100 mm. The fire pipe is advantageously installed in such a manner that it is in a vertical position inside the container 1, wherein the perpendicular distance of the fire pipe 3 to the wall of the container 1 is equally large everywhere. The fire pipe 3 can be supported for example with three horizontal iron bars placed in a suitable location in the height direction of the container, said iron bars pointing at different directions and being attached to the inner wall of the container 1 and touching the outer surface of the fire pipe 3. The fire pipe 3 extends above the level determined by the cover 4.

The cover 4 is intended to be placed on top of the container 1 during burning, said cover containing a lead-through for the fire pipe 3. The cover 4 is not essential, but it is necessary so that smoking combustion does not occur on the surface of the fuel layer and when the burner is moved, ash is not spread out of the burner.

The air intake pipe 2 supports a grate 5 that is a perforated round plate or a rigid net. The diameter of the holes is over 5 mm. In the middle of the grate 5 there is a lead-through for the fire pipe 3. The grate 5 promotes the combustion in such a manner that the fire dies down rapidly and it is possible to close the damper of the furnace earlier than in a situation where the burner is used without the grate 5.

The burner is used in such a manner that the container 1 is advantageously filled up to the brim in the volume above the grate 5 with solid fuel, such as pellets, wood chips or sawdust. The fire pipe 3 is advantageously surrounded with solid fuel advantageously in such a manner that the fire pipe 3 is in the middle of the burner. The cover 4 is positioned in its place after the filling. The burner is transferred to the furnace, in which the cross section of the air conduit should be larger than the cross section of the fire pipe, and kindling is placed on the bottom of the fire pipe 3, said kindling being for example tightly bundled paper that has been moistened with a suitable lighter fluid, for example with the lighter fluid for barbecue coal. Approximately 50 grams of kindling is a suitable amount. Fire is set in the burner setting the kindling on the bottom of the fire pipe 3 on fire via the air intake pipe 2.

The lighting phase takes a few minutes. At the lighting stage heat rises in the fire pipe 3 and gas starts being distilled from the fuel. The suction of the fire pipe 3 draws air through the wall of the container 1 via openings 6, and at the same time the distilled gas starts to flow from the edges of the container to the middle and further through the wall of the fire pipe 3 via openings 7, and the combustion of the gas begins. The burner burns with free draught, in other words air travels freely in the burner. The gas burns in a strong flame in the fire pipe 3 until the fuel ends. The duration of the burning depends for example on the moisture content of the fuel. When naturally humid wood chips are used in a 20 liter container with a air intake pipe 2 whose diameter is 50 mm, and a fire pipe 3 having a diameter of 100 mm, the lighting stage typically takes 5 to 10 minutes, and the actual combustion 20 to 90 minutes. The result is ash which is chilled in the burner inside the furnace before it is removed from the burner.

During the combustion high temperatures are produced when gas containing carbon monoxide burns in the fire pipe 3. The pillar of burning gas can extend 200 to 700 mm over the fire pipe. If for some reason one wishes to interrupt the burning, the end of the air intake pipe 2 is closed and time is allowed to pass until the flames are lowered in the upper end of the fire pipe 3. Thereafter the upper end of the fire pipe 3 is closed, and the burner is wrapped in a fire-blanket or the like to be transferred out for final extinguishing.

Figure 2:
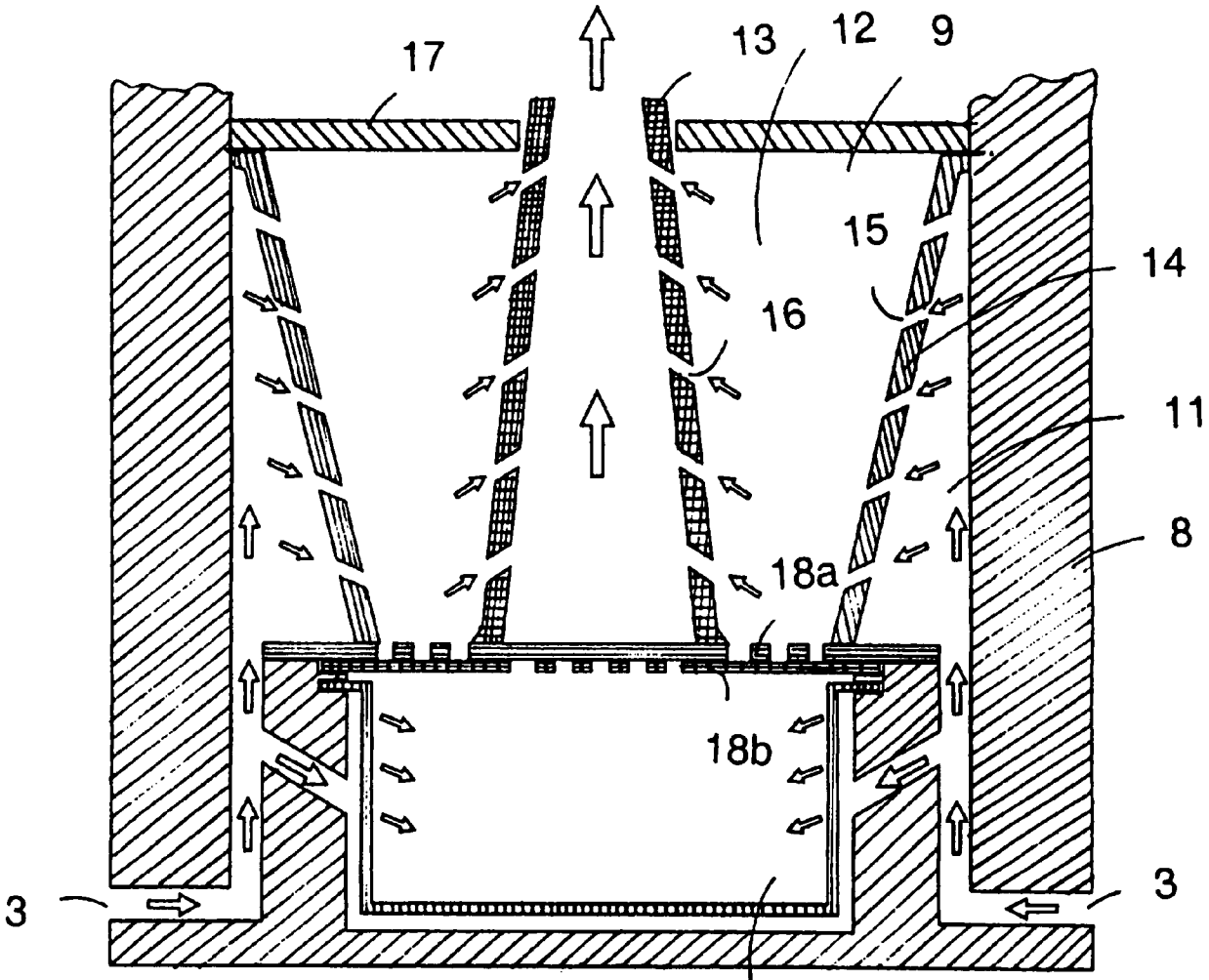
FIG. 2 shows a cross section of a furnace according to the third embodiment of the invention.

FIG. 2 shows a cross section of a furnace according to the invention. The mass of the furnace is advantageously 800 to 1000 kg, the energy output of the same is 8 to 10 kW/h at the highest. The amount of fuel burned at a time that advantageously consists of pellets, is 8 to 10 kg at the highest. The travel directions of the gas flows are shown by means of arrows in the drawing.

The furnace comprises a heat storing mantle 8, an adjustable opening for combustion gases (not shown in the drawing) and a combustion space 9. Replacement air flows to the air space 11 of the combustion space 9 via the air intake openings 10 located in the mantle 8.

In the middle of the combustion space 9 there is a fire pipe 13, outside and around of which pellets have been placed in the fuel space 12. On the wall of the fire pipe 13 there are openings 16 for flow of air. The diameter of the openings is advantageously 10 mm, and they cover approximately 40% of the surface area of the wall of the fire pipe 13. The openings of the fire pipe 16 extend from outside the fire pipe to the inside, when seen upwards from a lower level. The fire pipe 13 is open both in its upper and lower end. The cylindrical shape of the fire pipe 13 and on the other hand its mass guarantee that the fire pipe remains stationary. The conical shape together with the controlled flow of air promotes the combustion process, in other words the time it takes for the fire to die down is reduced. The material of the fire pipe can be ceramics, and the advantageous wall thickness is 8 to 12 mm. Another alternative for the material of the fire pipe is a fireproof iron alloy, wherein it is possible to utilize thinner walls than in connection with ceramics. The fire pipe 13 extends above the level determined by the cover 17.

The fuel space 12 is restricted from the air space 11 by a partition wall 14 that is equipped with openings 15 that enable the flow of replacement air. When seen from outside to the inside, the travel direction of the openings is downwards from an upper level, and the openings 15 are advantageously in an angle of 20° with respect to the vertical direction. Thus, the burning mass of fuel does not escape outside the fuel space 12. The partition wall 14 can be an element with the shape of a cut cone that expands towards its upper part. Alternatively, the partition wall can have a cylindrical shape, wherein the mantle of the furnace 8 must be shaped in such a manner that the air space 11 can be formed or the diameter of the cylinder must be substantially smaller than the combustion space. The partition wall can be made of ceramics, and an advantageous thickness of the partition wall is thus approximately 25 mm. The partition wall can also be made of fireproof iron alloy.

In the upper end of the fire pipe 13, around the same in a substantially horizontal position is a cover 17 closing the combustion space, said cover controlling the burning so that it takes place in the fire pipe 13 The upper surface of the cover 17 is typically on the same level with the lowest part of the doors of the furnace at the highest (not shown in the drawing) in such a manner that the fuel space 12 can be filled through the doors. The cover 17 promotes the complete combustion of the fuel and thus affects the amount of discharge. The cover 17 is preferably releasable, it can be formed of several parts, and it can be for example pivoted in the mantle 8, and/or the parts of the cover can be pivoted to each other.

The fire pipe 13 is erected on top of the grate that is composed of two fire grates 18*a* and 18*b*. The fire grate 18*a* is stationary and the fire grate 18*b* is movable. The stationary fire grate 18*a* advantageously contains holes with a diameter of 16 m, and they cover 30 to 50% of the surface area that remains inside the partition wall 14. The stationary fire grate 18*a* can extend to the side of the air space 11 in such a manner that it forms a plane on top of which the partition wall 14 can be installed. Both fire grates are perforated in such a manner that air can travel through the grate. The perforation is arranged in such a manner that by moving the fire grate 18*b* the openings in the sections of the grate located underneath the fire pipe become larger during the combustion and the openings in the section of the grate around the fire pipe become smaller. By means of this arrangement the aim is to ensure that the combustion air is sufficient in the fire pipe 13. In a preferred embodiment the holes have a maximum diameter of 16 mm, and minimum diameter of 6 to 8 mm. By moving the fire grate 18*b* when there is no fire in the furnace, it is possible to make the holes in the section of the grate remaining outside the fire pipe 13 larger and thus ash can be removed from the grate. In the area of the air space 11 in the fire grate there are not necessarily any holes.

Below the grate there is an ash space 19 which can be a box that can be taken out of the furnace to be emptied. In the mantle of the furnace there may be a door or the like for removal of the box, or it can be removed via the cover 17. The height of the ash space is advantageously approximately 15 cm.

To be able to fill the ash space, it is possible to use for example a can similar to a watering can which contains an oval base and flexible elongated pouring tip with a sufficiently large diameter. The cover 17 that closes the combustion space is opened for the duration of the filling and pellets are poured in the fuel space 12 by tilting the can. Another possibility is to use filling automatics that can conduct the filling in one or several stages, possibly also continuously during the combustion.

Fire is advantageously set into the furnace outside the fire pipe 13 by means of an electric resistance of 300 to 500 W that is installed inside the fuel space 12, the operating time of which resistance and the starting moment of the lighting can be controlled with an automatic function. The grate and the smoke damper of the furnace can be adjusted with an automatic function, such as by means of a microprocessor-controlled servomotor. The control of the electric resistance, the grate and the smoke damper of the furnace can be arranged as successive operations, wherein before the fire is set, the grate and the smoke damper are adjusted in a position suitable for the combustion. After the fire is set, the smoke damper is prevented from being closed for a period of time assumed as a combustion time. However, the smoke damper is closed only after the system receives information for example from a combustion gas detector that the concentration of the combustion gas has been reduced on a level that allows the closing of the damper.

Furthermore, the furnace may contain a unit intended for cleaning of combustion gases, which unit can be located in a suitable point in the exit route of combustion gases. The purpose of the cleaning unit is to remove all the small residues that possibly remain in the combustion gas when it exits to the outside air.

The invention is not restricted to the description above, but it may vary within the scope of the claims. In the solutions according to the first and second embodiment of the invention for example the following changes are possible: The solid fuel can also be waste, if the gasification of the same is sufficient for maintaining combustion. The air intake pipe and the fire pipe may be connected into one pipe. The part closing and opening the container is not necessarily the cover located on top of the container, but it can be some other part. The container may be equipped with legs, wherein in the bottom of the same there may be air intake openings, wherein the grate and/or air intake pipe is not absolutely necessary. Generally it can be said that the invention can be modified according to the environment in which it is used. In the solutions according to the third embodiment of the invention for example the following changes are possible: The geometrical shapes, sizes and placement of the different parts of the furnace with respect to each other may differ from that presented above. It is possible that the furnace has several fire pipes, which can be connected by intermediate air channels. The intermediate air channels may comprise conical pipes with closed ends that are installed in a vertical position, as well as pipes connecting the same.

The invention claimed is:

1. A solid fuel burner, comprising:

a space for solid fuel to be burned;

a base bordering the space;

a top comprising a cover bordering the space for solid fuel;

at least one side wall bordering the space for solid fuel and extending between the base and the top and including non-adjustable air intake openings;

a grate arranged inside the space for solid fuel within fixed distance from the base;

an ash space located below the grate;

at least one substantially vertical fire pipe arranged inside the space for solid fuel and arranged to be surrounded by the solid fuel, the fire pipe comprising a wall, a lower end, an open upper end, openings in the wall to permit air to flow between the fire pipe and the space for solid fuel, and an air intake at the lower end, the fire pipe extending through the cover such that a perpendicular distance between the fire pipe and the side wall from the top to the base is constant; and a substantially horizontal air intake pipe connected to the lower end of the fire pipe at a point between the grate and the base, the air intake pipe comprising a first open end arranged outside of the at least one side wall of the burner and a second open end arranged within the fire pipe, wherein the second open end is not directly connected to the ash space.

2. The burner according to claim 1, wherein the fire pipe is a perforated pipe arranged in a substantially vertical position in the solid fuel space, in which pipe the surface area of the openings is over 30%, advantageously at least 40% of the entire surface area of the wall of the fire pipe remaining inside the solid fuel space.

3. The burner according to claim 1, wherein the burner is arranged to distil combustible gases from solid fuel and to burn them in the fire pipe.

4. The burner according to claim 1, wherein the burner is arranged to burn pellets.

5. The burner according to claim 1, wherein the burner is a burner that can be positioned in an existing furnace, or it can be used as such without the surrounding furnace.

6. The burner according to claim 5, wherein the solid fuel space is a container.

7. The burner according to the claim 5, wherein the burner has free draught.

8. A solid fuel burner, comprising:

a container comprising a bottom, a top including a cover and at least one side wall extending between the top and the bottom, the at least one side wall comprising non-adjustable air intake openings;

a grate arranged inside the container within fixed distance from the bottom of the container;

an ash space located below the grate;

at least one substantially vertical fire pipe arranged within the container and including a wall, a lower end, an upper end, and openings in the wall, the fire pipe being open from its upper end, the fire pipe extending through the cover such that a perpendicular distance between the fire pipe and the side wall from the top to the base is equally large, wherein a space between the fire pipe and the side wall is arranged to receive solid fuel and the fire pipe is arranged to be surrounded by solid fuel; and a substantially horizontal air intake operatively connected to the lower end of the fire pipe at a point under the grate, the air intake pipe comprising a first open end arranged outside of the at least one side wall of the burner and a second open end arranged within the fire pipe, wherein the second open end is not directly connected to the ash space.

* * * * *